United States Patent [19]

McDougall

[11] Patent Number: 4,624,172

[45] Date of Patent: Nov. 25, 1986

[54] GUITAR PICKUP POLE PIECE

[76] Inventor: Glenn McDougall, Saskatoon, Saskatchewan, Canada

[21] Appl. No.: 739,045

[22] Filed: May 29, 1985

[51] Int. Cl.[4] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,911,871 | 11/1959 | Schultz | 84/1.15 |
| 4,051,761 | 10/1977 | Nylen | 84/1.15 |
| 4,133,243 | 1/1979 | DiMarzio | 84/1.15 |

*Primary Examiner*—Stanley J. Witkowski

*Attorney, Agent, or Firm*—Stanley G. Ade

[57] ABSTRACT

A pickup assembly for stringed instruments such as guitars or the like, consists of a hollow cylindrical tube of magnetizable material in contact with a permanent magnet to produce an electro-magnetic field one upon each side of one free end of the cylinder and a resistive field coil in operative connection with the cylinder in a conventional manner. The vibrating string of the instrument passes diametrically over the open end of the pole piece cylinder spaced slightly above the surface thereof and between the two magnetic fields which are situated one upon each side of the longitudinal axis of the string. This permits free vibration of the string at all frequencies without any dampening or attenuation occurring.

18 Claims, 9 Drawing Figures

FIG. 3A
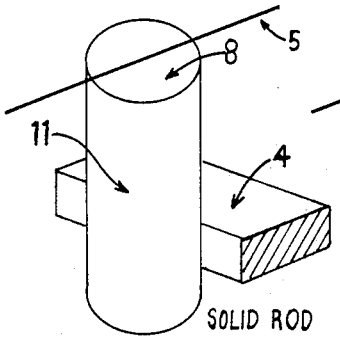
FIG. 3B
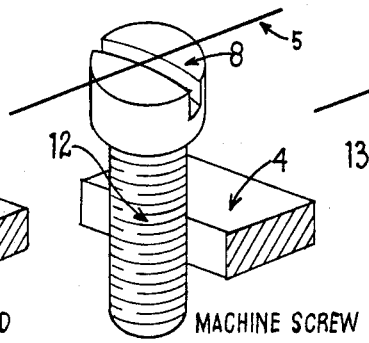
FIG. 3C
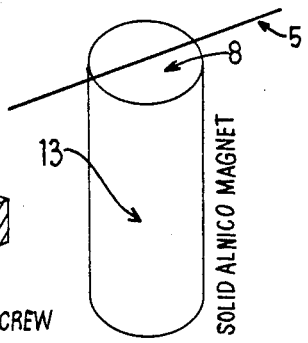
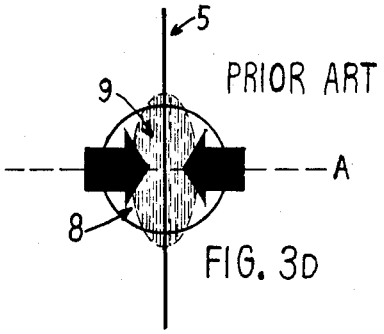
FIG. 3D
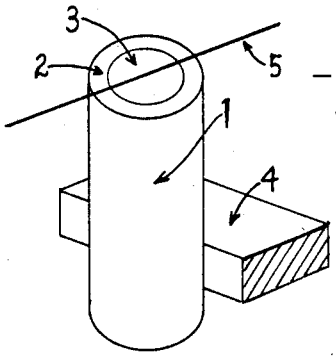
FIG. 4A
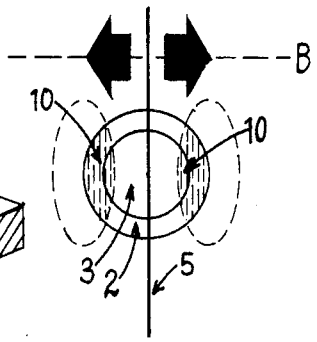
FIG. 4B

GUITAR PICKUP POLE PIECE

BACKGROUND OF THE INVENTION

This invention relates to new and useful improvements to a tubular pole piece assembly for stringed musical instrument pickups such as pickups for guitars and the like although it is not restricted to use with guitars. As is conventional in the prior art, the tubular pole pieces are contained within the inner core of a wire-wound field of the pickup and each string is served by a separate, solid, tubular pole piece positioned directly under, and in the center of the vibrational loop path of the string.

Each tubular pole piece is energized by means of direct contact with a permanent magnet bar of ceramic, Alnico, or other preferred permanent magnet material. As is functionally applied in prior art, the tubular pole piece emits magnetic flux, or force upwardly into the vibrational loop of the string to magnetize the string. When plucked, the motion of the string cuts the flux lines disturbing the magnetic field of the tubular pole piece to create inductive force into the resistive field coil, converting mechanical motion into electrical current, or signal for amplification.

The disadvantage of prior art pole piece types, specifically, solid steel rod (e.g. U.S. Pat. No. 3,983,778) solid steel machine screw (e.g. U.S. Pat. Nos. 2,175,325 and 3,715,446) and solid Alnico rod permanent magnets (e.g. U.S. Pat. No. 4,320,861) is their concentration of diametric central magnetic force against the vibration, or free movement of the string. The prior art pole piece end face emits motion restricting magnet force centrally and longitudinal with the string. As will be described the zone of strongest magnetic force is in the direct center of the pole piece end face under and along the vibrational loop path of the string.

The motion limiting effect of the magnetic force field multiplies progressively as string lengths are physically shortened by depressing the strings onto the frets, particularly in upper registers of the fingerboard of the instrument where the highest frequencies originate. The vibration loop of the string decreases in width as frequencies increase in Hertz, or cycles per second. Narrower high frequency vibration loops have less momentive inertia to vibrate freely and to full potential within the strong magnetic force field.

Fundamental note definition, intricate harmonic overtones, precise note intonation within chord forms, sustain time, and a degree of output signal, or power value to the amplifier, are sacrificed because the string is physically unable to vibrate freely enough to develop a perfect harmonic spectrum.

SUMMARY OF THE INVENTION

The main object of the present invention is to eliminate diametric central magnetic force from pickup pole pieces onto the vibrating strings of stringed electrical musical instruments.

Since a pickup is a sensing device to string vibrations, it is capable of reproducing only what is fed into it. If the magnetic field of the pickup is distorting and limiting the width and form of the vibrational loop of the string the pickup is able only to sense and reproduce that wave form, and sustain sound for whatever time duration the string stays in motion.

The present invention, a hollow tubular pole piece, interfaces the magnetic field in perspective with the strings to allow vibrational loops to move in total freedom of force field limitation.

To dispose of string motion limitations evident with prior art pole piece types, central mass is removed through use of a hollow, or tubular pole piece unit under each string, in effect, cancelling magnetic force from one point, or zone, and assigning it to another point where it becomes assistive, rather than resistive to the motion of the string.

Vastly improved functional, and tonal advantages become evident in the form of (1) Pure and true note definition at every working volume level, (2) Complete and accurate reproduction of complex harmonic overtones, (3) No string loop distortion, or frequency disruptions that create intonation errors within chord form, (4) Greatly lengthened span of string sustain, (5) Finer playing response and sensitivity in all fret registers, (6) Improved control over high-gain harmonic feedback, (7) Full output power potential to the amplifier, and special electronic effects devices.

In accordance with the invention there is provided a pole piece assembly for use with a pickup for a stringed instrument which includes at least one vibration-producing string comprising in combination a hollow cylinder of magnetizable material, means to magnetically energize said cylinder and a resistive field coil operatively connected to said pole piece, said string passing diametrically over one end of said hollow cylinder in operative relationship therewith.

Another advantage of the invention is to provide a device of the character here within described which is simple in construction, economic in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 3A is an isometric view of a prior art, solid steel rod pole piece in contact with the bar magnet, and the string passing across the diametric end sphere or end face thereof.

FIG. 3B is an isometric view of a prior art, solid steel machine screw pole piece in contact with the bar magnet, and the string passing across the diametric end sphere thereof.

FIG. 3C is an isometric view of a prior art, solid Alnico rod permanent magnet with the string passing across the diametric end sphere thereof.

FIG. 3D is a top plan view of the diametric end sphere of prior art pole pieces in FIGS. 3A, 3B and 3C, showing the capture of the string in the strong magnetic force field across the diameter.

FIG. 4A is an isometric view of a hollow tubular pole piece in contact with the bar magnet, and the string passing across the circumferential end rim thereof.

FIG. 4B is a top plan view of a tubular pole piece, showing the string passing across the hollow, magnetic force-free center, and narrow low force circumferential rim, with the lateral force field on either side of the string.

In the drawings like characters of reference indicate corresponding parts in the different figures.

DETAILED DESCRIPTION

Figure 1A:
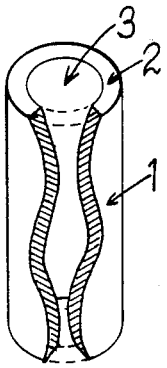
FIG. 1A is a cutaway isometric view of a tubular pole piece, exposing the hollow center bore, slide wall, and circumferential end rim.

Proceeding therefore to describe the invention in detail, the principle of the low magnetic force, tubular pole piece, can be understood in the cutaway structure of a hollow cylindrical pole piece illustration in FIG. 1A, showing the thin steel wall 1 in the circumferential end rim 2, with the center bore 3 running the vertical length of the center of the pole piece.

Figure 1B:
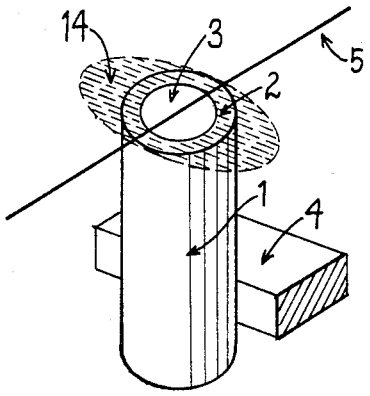
FIG. 1B is an isometric view of a tubular pole piece in contact with the bar magnet, with the string passing across the magnetically energized circumferential end rim.

FIG. 1B shows the tubular pole piece 1 with a string 5 spanning the circumferential end rim 2, but spaced slightly above the rim, and the mass-free center bore 3. Magnetic energization 14 is transferred by direct contact of the permanent magnet bar 4 to the pole piece 1 in the usual manner.

Figure 2:
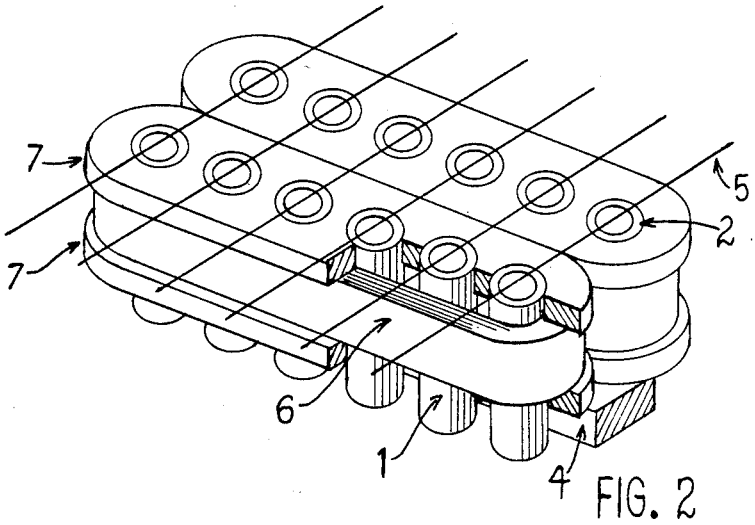
FIG. 2 is a cutaway isometric view of a pickup embodiment, with tubular pole pieces in functional pose.

The tubular pole piece 1 units are embodied into either double, or single coil pickups. FIG. 2 exposes cutaway sections of the conventional coil bobbin plates 7, wire wound field coil 6 and the central core positioning of the novel tubular pole pieces 1 in direct contact with the permanent magnet bar 4 on each side thereof. Strings 5 are shown passing across the top face plane of the pickup, with each string 5 aligning in direct center with or extending diametrically across the magnetic force emitting circumferential end rims 2 that direct the magnetic field into the vibrational loop path of each string 5.

Using FIG. 4A as a comparative reference between prior art FIGS. 3A, 3B and 3C, it is established that the diametric end 8 of prior art pole piece types, are composed of solid mass that imposes a restrictive magnetic drag on the motion of string 5. By opposite theory, the circumferential end rim 2 in FIG. 4A imposes only a light magnetic force on the string 5, while the hollow center bore 3 over which the string passes, has no force whatsoever. In both the prior art, and the present invention, calculation of magnetic field force 9—FIG. 3D, and 10—FIG. 4B, is determined by the ratio of central mass to the total diameter of the pole piece unit indicated at 8 in FIG. 3D, and 2 in FIG. 4B.

Examining FIG. 3D of prior art, a direct plan view of the solid mass end 8 shows the string 5 passing across the maximum zone of magnetic force 9, that being the diameter. Inwardly directed arrows along line A depict the tendency of the force field 9 to halt the movement of the string 5.

FIG. 4B of the novel hollow tubular pole piece, shows a plan end view of the circumferential rim 2 with the string 5 passing across the mass-free hollow center bore 3. The string 5 has the potential to vibrate in free suspension, with only a narrow field of force on the diametric areas where the string 5 intersects the circumferential rim 2. The magnetic field is divided upon each side of the string and is situated around the wall of the hollow cylinder on each side of the string and spaced therefrom as shown by reference character 10. The main concentration of the magnetic force 10 is now in lateral posture to the string 5, rather than longitudinally as shown in 9—FIG. 3D of the prior art. With the main force field 10 shifted to either side of the string 5, the physical tendency thereof is to develop its complete, or widest vibrational loop, moving from side to side between the lateral force fields 10 as depicted by the outwardly directed arrows along line B. In practical application, the lateral force field 10 influences the string 5 to develop its maximum loop width in every frequency increment.

The tubular pole piece invention is adaptable to all common pickup field coil types and configurations used to reproduce electric guitar, bass, steel guitar, mandolin and the like.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A pole piece assembly for use with a pickup for a stringed instrument which includes at least one vibration-producing string comprising in combination a pole piece, said pole piece consisting of a relatively thin-walled hollow cylinder of magnetizable material having no magnetizable mass within the bore thereof, means to magnetically energize said cylinder and a resistive field coil operatively connected to said pole piece, said string passing diametrically over one open end of said hollow cylinder in operative relationship therewith.

2. The assembly according to claim 1 in which said means to magnetically energize said cylinder comprises a permanent magnet in contact with the other end of said cylinder.

3. The assembly according to claim 1 in which said resistive field coil surrounds said pole piece intermediate the ends thereof.

4. The assembly according to claim 2 in which said resistive field coil surrounds said pole piece intermediate the ends thereof.

5. The assembly according to claim 1 which includes a bobbin, said bobbin having an upper face and a spaced and parallel lower face with said resistive field coil wound thereon and a plurality of hollow pole pieces in spaced apart relationship extending through said bobbin and said field coil and being held by said upper and lower plates, and a vibration-producing string extending diametrically across said one open end of each of said pole pieces each in operative relationship with the corresponding pole piece.

6. The assembly according to claim 2 which includes a bobbin, said bobbin having an upper face and a spaced and parallel lower face with said resistive field coil wound thereon and a plurality of hollow pole pieces in spaced apart relationship extending through said bobbin and said field coil and being held by said upper and lower plates, and a vibration-producing string extending diametrically across said one open end of each of said pole pieces each in operative relationship with the corresponding pole piece.

7. The assembly according to claim 3 which includes a bobbin, said bobbin having an upper face and a spaced and parallel lower face with said resistive field coil wound thereon and a plurality of hollow pole pieces in spaced apart relationship extending through said bobbin and said field coil and being held by said upper and lower plates, and a vibration-producing string extending diametrically across said one open end of each of said pole pieces each in operative relationship with the corresponding pole piece.

8. The assembly according to claim 1 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

9. The assembly according to claim 2 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

10. The assembly according to claim 3 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

11. The assembly according to claim 4 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

12. The assembly according to claim 5 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

13. The assembly according to claim 6 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

14. The assembly according to claim 7 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

15. A pickup in combination with a vibration producing string of a stringed musical instrument, said pickup including a pole piece, said pole piece comprising a hollow cylinder of magnetizable material, means to magnetically energize said cylinder and a resistive field coil operatively connected to said hollow cylinder, said string passing diametrically over one open end of said hollow cylinder in operative relationship therewith.

16. The assembly according to claim 15 in which said resistive field coil surrounds said pole piece intermediate the ends thereof.

17. The assembly according to claim 15 which includes a bobbin, said bobbin having an upper face and a spaced and parallel lower face with said resistive field coil wound thereon and a plurality of hollow pole pieces in spaced apart relationship extending through said bobbin and said field coil and being held by said upper and lower plates, and a vibration-producing string extending diametrically across one end of each of said pole pieces each in operative relationship with the corresponding pole piece.

18. The assembly according to claim 15 in which the effective magnetic field of said pole piece is divided and situated around the wall of said hollow cylinder with the major effect thereof occurring at diametrical locations perpendicular to the longitudinal axis of the string extending thereover and spaced from said string, one on each side thereof.

* * * * *